US005379783A

United States Patent [19]

Healzer et al.

[11] Patent Number: 5,379,783

[45] Date of Patent: Jan. 10, 1995

[54] GARLAND ACCESSORY

[75] Inventors: Janelle L. Healzer, 200 Estes, Nixa, Mo. 65714; Gaylen D. Healzer, Nixa, Mo.

[73] Assignee: Janelle L. Healzer, Nixa, Mo.

[21] Appl. No.: 161,225

[22] Filed: Dec. 2, 1993

Related U.S. Application Data

[63] Continuation-in-part of Ser. No. 7,278, Apr. 21, 1993.

[51] Int. Cl.[6] ..... A45D 8/22; A45D 8/28

[52] U.S. Cl. ..... 132/279; 132/275; 132/278

[58] Field of Search ..... 132/275, 278, 279; 24/6, 327, 458, 529

[56] References Cited

U.S. PATENT DOCUMENTS

| | | | |
|---|---|---|---|
| 1,007,586 | 10/1911 | Martin | 132/275 |
| 1,077,345 | 11/1913 | Hines et al. | 132/275 |
| 1,470,631 | 10/1923 | Marion | 132/275 |
| 1,480,935 | 1/1924 | Gleason | 132/278 |
| 2,169,596 | 8/1939 | Solomon | 132/275 |
| 2,337,782 | 12/1943 | Taffae | 132/275 |
| 5,154,196 | 10/1992 | Moffat | 132/275 |

FOREIGN PATENT DOCUMENTS

| | | | |
|---|---|---|---|
| 560351 | 7/1923 | France | 132/275 |
| 589579 | 2/1925 | France | 132/279 |

*Primary Examiner*—Gene Mancene
*Assistant Examiner*—Frank A. LaViola
*Attorney, Agent, or Firm*—Hovey, Williams, Timmons & Collins

[57] ABSTRACT

A garland accessory for permitting a wearer to custom decorate her apparel is provided which includes a framework detachably mounted to a clasp. The framework is a thin flexible sheetlike material presenting a plurality of openings for receiving a fabric garland therein. Multiple frameworks may be used with the same clasp to permit ready substitution of different fabric garlands as desired by the user.

8 Claims, 2 Drawing Sheets

GARLAND ACCESSORY

This application is a continuation-in-part of our pending design application Ser. No. 29/007,278, filed Apr. 21, 1993 pending, the disclosure of which is incorporated herein by reference thereto.

BACKGROUND OF THE INVENTION

1. Field of the Invention

This invention broadly concerns an apparel accessory for receiving a garland of fabric therein, and more particularly is directed toward an accessory to be worn as a barrette or hair ornament. The invention includes a framework for receiving a garland of fabric in combination with a clasp whereby the user may custom decorate the accessory with a chosen fabric pulled through the lattice-like framework.

2. Description of the Prior Art

Hair bows, barrettes, ribbons and other decorative accessories of various types are well known in the art and encompass a broad spectrum of designs. Furthermore, pins which decorate articles of clothing are well known to include an ornamental covering secured to the fabric by a hinged pin. Users typically purchase these ornaments largely according to the appearance of the material or emblem carried by the pin.

However, the user frequently changes clothing and as a result, desires a different appearance for the decorative accessories. For example, in the way that a woman would wear a different scarf with different clothing outfits, she may also desire a different decorative accessory with those different outfits. Heretofore, decorative accessories such as hair bows, pins and the like presenting a gathered fabric appearance have been sewed or otherwise permanently affixed to the hardware and thus have been incapable of such adaptation. As a result that the same basic underlying hardware must be repeatedly purchased even though that hardware is largely unseen and immaterial to the decorative desirability of the article.

There has thus arisen a need for a decorative accessory capable of presenting a gathered fabric appearance, which is inexpensive to manufacture, and which may receive different fabrics in substitution.

SUMMARY OF THE INVENTION

These and other objects have largely been met by the garland accessory of the present invention. That is to say, the present invention enables the user to employ a variety of different "looks" by readily substituting different garlands of fabric with the same ornament.

Broadly speaking, the present invention employs a clasp for attachment to the hair or clothing of the wearer, a retaining member associated with the clasp, and a framework of flexible material presenting a plurality of openings sized to receive a portion of a fabric garland therein. As used herein, the term "garland" means a length of fabric material which may be normally flat but when pulled into the openings of the framework presents a gathered or billowing appearance. Exemplary of a fabric garland would be a handkerchief, scarf or the like.

The clasp may include a barrette frame or the hinged jewelry pin framework well known to those skilled in the art, such that the present invention includes applications both for wear in the hair but also could be employed on hats, jackets, sweaters or other articles of clothing. Various different frameworks may be associated with the clasp by simply removing one framework and substituting another. The framework readily attaches to the clasp by positioning the framework over the clasp and bending mounting tabs beneath retaining flanges extending from the opposed end of the clasp. The wearer may readily substitute multiple frameworks each having a different configuration and carrying a different garland selected by the wearer, or alternatively one framework can be removed and different fabric garlands pulled therethrough. The present invention has the further advantage that a garland such as a scarf can be used either in a hair or clothing ornament or as a scarf, thus lending further versatility to the user's wardrobe.

These and other objects of the present invention may be readily perceived by reference to the drawings and the written description which follows.

DESCRIPTION OF THE PREFERRED EMBODIMENT

Figure 1:
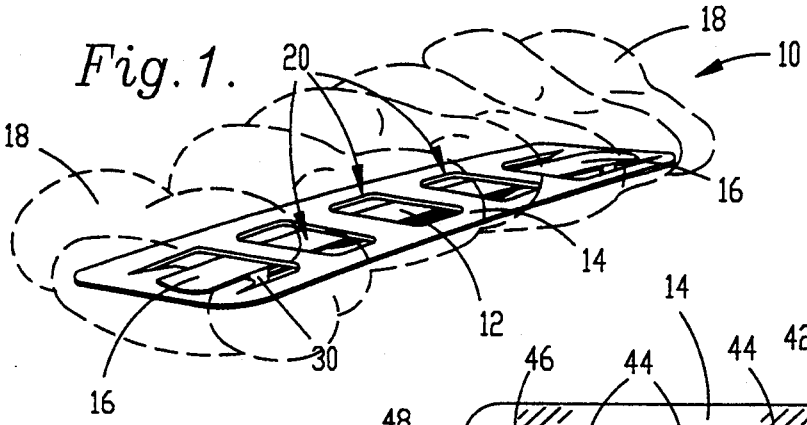
FIG. 1 is a top front perspective view of the garland accessory of the present invention with the fabric garland shown in phantom to better show the positioning of the clasp and framework relative thereto.
Figure 2:
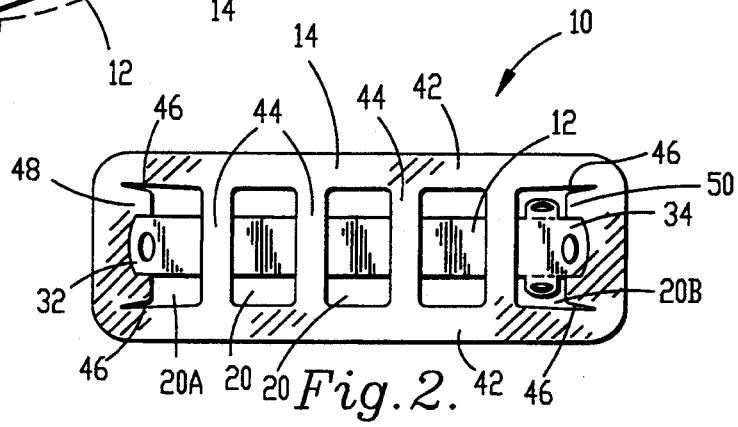
FIG. 2 is a top plan view of the garland accessory hereof not including the fabric garland.
Figure 6:
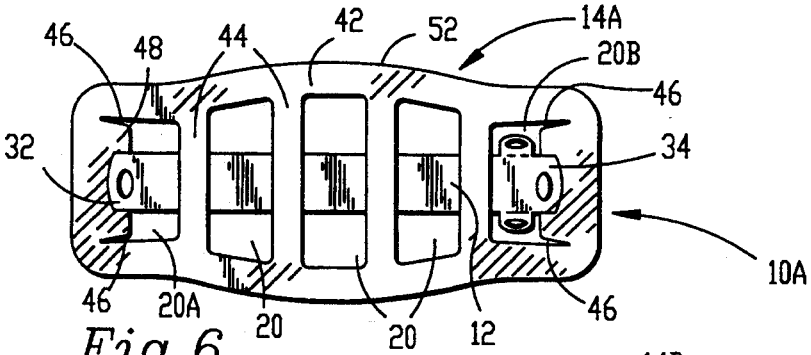
FIG. 6 is a top plan view of an alternate embodiment of the garland accessory hereof not including the fabric garland, showing an alternate framework configuration.
Figure 10:
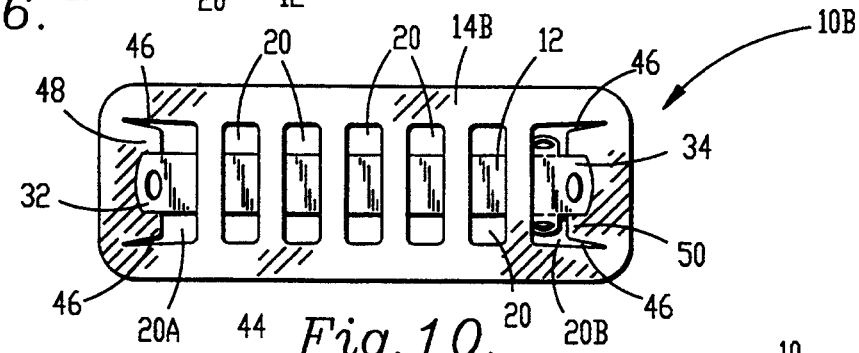
FIG. 10 is a top plan view of a second alternate embodiment of the garland accessory hereof not including the fabric garland, showing a second alternate framework configuration.

Referring now to the drawing a garland accessory 10 in accordance with the present invention broadly includes a clasp 12 and a flexible framework 14. The clasp includes a retaining member 16 for holding the framework 14 on the clasp 12. A fabric garland 18 of suitable material such as silk, linen, cotton, or other natural or synthetic material is shown in FIG. 1 and held in position by pulling portions thereof through openings 20 provided in the framework.

Figure 14:
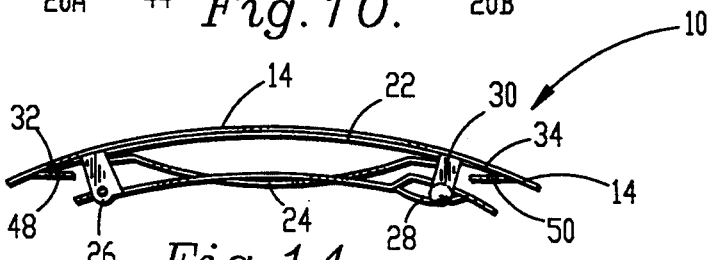
FIG. 14 is a front elevational view of the garland accessories shown in FIGS. 2, 6 and 10, the back view being a mirror image thereof.
Figure 8:
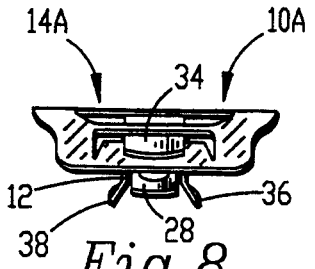
FIG. 8 is a right side view thereof.
Figure 3:
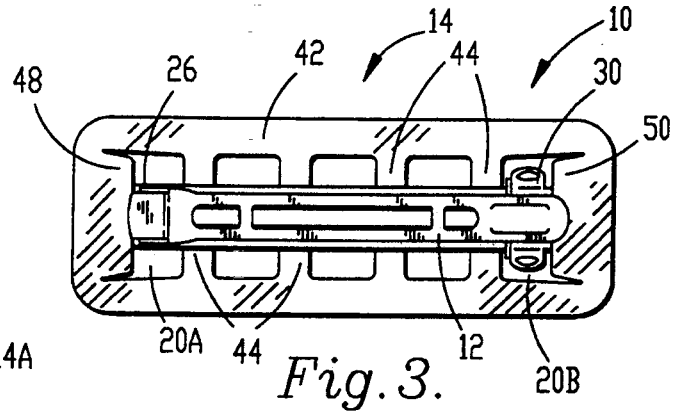
FIG. 3 is a bottom view thereof.
Figure 9:
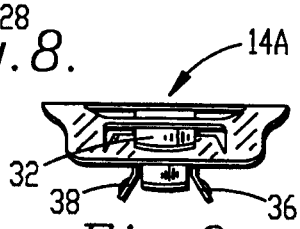
FIG. 9 is a left side view thereof.
Figure 7:
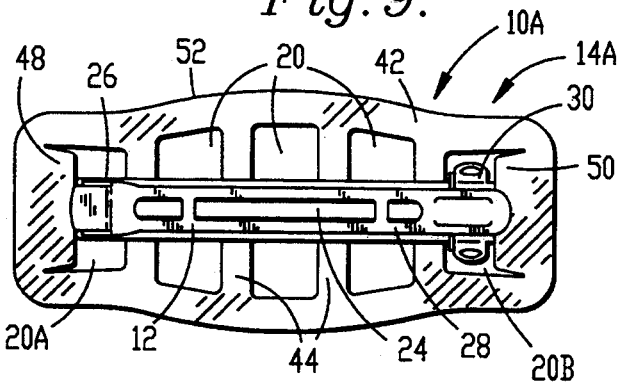
FIG. 7 is a bottom view thereof.
Figure 4:
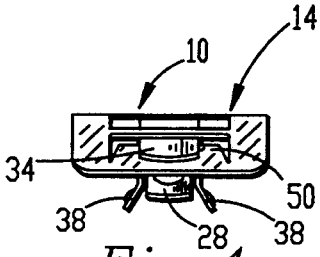
FIG. 4 is a right side view thereof.
Figure 5:
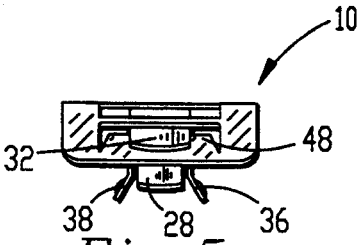
FIG. 5 is a left side view thereof.
Figure 13:
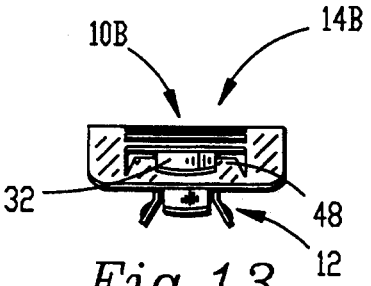
FIG. 13 is a left side view thereof.
Figure 11:
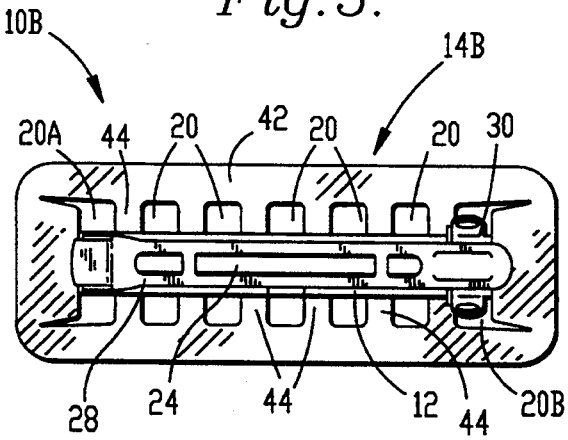
FIG. 11 is a bottom view thereof.
Figure 12:
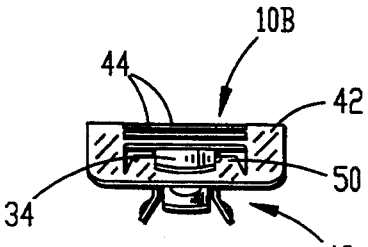
FIG. 12 is a right side view thereof.

In greater detail as best seen in FIG. 14, clasp 12 is of conventional design and includes an elongated arcuate upper beam 22, a spring element 24, a hinge support member 26, a fastening member 28 pivotally mounted thereto; and a catch 30 for holding the fastening member in a position generally parallel to the upper beam 22. Retaining member 16 generally comprises flanges 32 and 34 extending longitudinally in opposite directions from beam 22. The catch 30 may include legs 36 and 38 for holding the remote end 40 of the fastening member 28 therebetween. Such clasps 12 are generally familiar to those skilled in the art and are used as barrettes. Alternatively, jewelers backing pins with hinged or other pin-type members would provide suitable clasps 12 when the garland accessory 10 hereof is used with articles of clothing.

Framework 14 shown in FIGS. 1 through 5 includes a surrounding border 42 and a plurality of transversely extending dividers 44 connected to the border 42 for defining a plurality of openings 20. The framework 14 is preferably made of synthetic resin sheets or film which are easily cut or formed into a desired configuration and a resilient for purposes of mounting to the clasp 10 and holding the fabric garland 18 thereto. At least some and preferably all of the openings are sized to receive portions of the fabric garland 18 therethrough. A ladder-like appearance is thus provided for the framework 14. The openings 20A and 20B at the opposite ends of the framework 14 are provided with longitudinally extending slits 46 extending into the border 42. The slits 46 define tabs 48 and 50 on the framework 14 which is bent into position below flanges 32 and 34 respectively when the framework 14 is mounted to the clasp 12, as seen in FIG. 14.

Garland accessory 10A shown in FIGS. 6 through 9 is substantially the same as garland accessory 10 of FIGS. 1 through 5, with the exception of the configuration of the framework 14A. The framework 14 presents a somewhat different ornamental appearance than that of framework 10 by presenting a circumscribing margin 52 around the border 42 which has a greater transverse dimension, thereby permitting the center opening to have a greater width than those on either side.

Garland accessory 10B shown in FIGS. 10 through 13 is also substantially the same as garland accessory 10, however including a framework 14B of a different ornamental appearance. Framework 14B includes a greater number of dividers 44 which are provided for creating a greater number of smaller openings 20 for receiving the fabric garland 18 therein.

The garland accessories 10, 10A and 10B as shown herein are particularly useful as hair ornaments in the manner of a barrette. In use, the wearer typically detaches the desired framework 14 and positions a fabric garland above the framework 14. By pulling desired portions of the fabric garland 18 through the openings 20, that part of the fabric garland 18 positioned above the framework 14 takes on a gathered or billowing appearance. No fasteners are needed to hold the fabric garland 18 in place as the compressed fabric bears against the border 42 and dividers 44 of the framework and is held therein. The user may easily attach the framework 14 to the clasp 12 after the fabric garland 18 has been attached by locating tabs 48 and 50 beneath the flanges 32 and 34. The resiliency of the synthetic resin framework 14 conforms over the arcuate surface of beam 22 as shown in FIG. 14 and the tabs 48 and 50 hold the framework 14 and the fabric held therein against longitudinal, lateral and vertical movement relative to the clasp 12. The wearer then opens the clasp in the conventional manner and clamps a portion of her hair between the spring 24 and the fastening member 28 as is well known to users of barrettes.

If the wearer maintained a set of different frameworks 14, 14A and 14B, the framework 14 can be easily removed without tools as the flanges have no fastening members to secure the tabs 48 and 50. The fabric garland 18 is easily removed from the framework 14 by simply pulling the garland 18 away from the framework. A new garland may then be substituted on the framework 14 and then reinstalled on the clasp. As the garland 18 substantially completely covers the framework 14 and the clasp 12, an ornamental appearance selected by the wearer may be readily and inexpensively achieved.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby states their intent to rely on the Doctrine of Equivalents to determine and assess the reasonably fair scope of their invention as pertains to any apparatus not materially departing from but outside the liberal scope of the invention as set out in the following claims.

We claim:

1. A garland accessory comprising:

a clasp having a pair of opposed ends and presenting an elongated upper beam, a fastening member for securing hair or other material mounted for movement relative to the beam, and a catch for holding the fastening member in position relative to the beam;

a retaining member projecting from the beam proximate each of the ends;

a framework of resilient material separable from said clasp, said framework presenting a first opening, a second opening, and at least one additional opening therebetween, each of said openings being sized for receiving and holding a portion of a fabric garland therein and a pair of tabs provided adjacent said first and second openings.

said tabs releasably attaching said framework to said retaining member in an engagement fit on the opposite side of said beam than said fastening member.

2. A garland accessory as set forth in claim 1 wherein said retaining member comprises a pair of flanges integrally formed with said clasp.

3. A garland accessory as set forth in claim 1, wherein said retaining member 18 substantially free of fasteners for fixing said framework to said clasp,

4. A garland accessory as set forth in claim 1, wherein said framework is made of synthetic resin material

5. A garland accessory as set forth in claim 1, including a garland of fabric extending substantially in covering relationship over said framework with portions of said fabric garland held in said framework.

6. A garland accessory as set forth in claim 1, wherein said clasp includes an elongated fastening member and a hinge support member pivotally carrying said fastening member.

7. A garland accessory as set forth in claim 1, including a plurality of frameworks interchangeably mountable on said clasp.

8. A garland accessory as set forth in claim 1, wherein said framework presents openings having a width substantially greater than the width of said beam.

* * * * *